US011183113B2

(12) United States Patent
Lhee et al.

(10) Patent No.: US 11,183,113 B2
(45) Date of Patent: Nov. 23, 2021

(54) DISPLAY DEVICE AND DRIVING METHOD OF THE DISPLAY DEVICE

(71) Applicant: Samsung Display Co., Ltd., Yongin-si (KR)

(72) Inventors: Zail Lhee, Yongin-si (KR); Yong Sung Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/797,525

(22) Filed: Feb. 21, 2020

(65) Prior Publication Data

US 2020/0312240 A1 Oct. 1, 2020

(30) Foreign Application Priority Data

Mar. 25, 2019 (KR) ..... 10-2019-0033888

(51) Int. Cl.

| | |
|---|---|
| ***G09G 3/3225*** | (2016.01) |
| ***G09G 3/3266*** | (2016.01) |
| ***G09G 3/3275*** | (2016.01) |
| ***G09G 3/36*** | (2006.01) |
| ***G09G 3/3233*** | (2016.01) |

(52) U.S. Cl.

CPC ..... *G09G 3/3225* (2013.01); *G09G 3/3233* (2013.01); *G09G 3/3266* (2013.01); (Continued)

(58) Field of Classification Search

CPC .. G09G 3/3648; G09G 3/3614; G09G 3/3688; G09G 3/2803; G09G 3/3607; G09G 3/2022; G09G 2310/02; G09G 2360/16; G09G 2320/0276; G09G 2320/0238; G09G 2320/0271; G09G 2320/0233; G09G 2320/0242; G09G 2320/0646; (Continued)

(56) References Cited

U.S. PATENT DOCUMENTS 6,879,310 B2 * 4/2005 Nose ..... G09G 3/3607 345/88
7,106,350 B2 * 9/2006 Baba ..... G09G 3/3614 345/691

(Continued)

FOREIGN PATENT DOCUMENTS

| | | | |
|---|---|---|---|
| JP | 3530477 | B2 | 5/2004 |
| KR | 10-2011-0085399 | A | 7/2011 |
| KR | 10-2018-0013189 | A | 2/2018 |

*Primary Examiner* — Dismery Mercedes

(74) *Attorney, Agent, or Firm* — Lewis Roca Rothgerber Christie LLP

(57) ABSTRACT

A display device includes: a display panel including a plurality of pixels, a pixel from among the pixels being coupled to a scan line and a data line; a scan driver configured to supply a first scan signal to the scan line in a scan period in one frame, and to supply a second scan signal to the scan line in a compensation period after the scan period; and a data driver configured to supply a first data signal to the data line in synchronization with the first scan signal, and to supply a second data signal to the data line in synchronization with the second scan signal, wherein the first data signal is generated based on input image data supplied from an image source, and the second data signal is generated based on a conversion image data obtained by converting a grayscale of the input image data.

20 Claims, 6 Drawing Sheets

(52) U.S. Cl.
CPC ..... *G09G 3/3275* (2013.01); *G09G 3/3607* (2013.01); *G09G 3/3614* (2013.01); *G09G 3/3648* (2013.01); *G09G 3/3674* (2013.01); *G09G 3/3696* (2013.01); *G09G 2310/027* (2013.01); *G09G 2320/0233* (2013.01); *G09G 2320/0242* (2013.01); *G09G 2320/0271* (2013.01); *G09G 2320/0626* (2013.01)

(58) Field of Classification Search
CPC ..... G09G 2320/064; G09G 2320/0673; G09G 2320/10; G09G 2320/045; G09G 2310/027; G09G 2310/0254; G09G 2310/0256; G09G 2310/0243; G09G 3/3266; G09G 3/3233; G09G 3/2007; G09G 3/3275; G09G 3/3677; G09G 3/3696; G09G 3/3225; G09G 2340/0435; G09G 2340/0428; G09G 2330/028; G02F 1/134345; G02F 2203/30
See application file for complete search history.

(56) References Cited

U.S. PATENT DOCUMENTS

| | | | | |
|---|---|---|---|---|
| 7,855,710 | B2 * | 12/2010 | Ito | G09G 3/2011 345/103 |
| 9,110,300 | B2 * | 8/2015 | Kim | G02B 30/24 |
| 9,183,780 | B2 * | 11/2015 | Kim | G09G 3/3233 |
| 9,557,954 | B2 | 1/2017 | Jepsen et al. | |
| 10,311,793 | B2 * | 6/2019 | Chai | G09G 3/3233 |
| 10,600,362 | B2 * | 3/2020 | Chaji | G09G 3/2022 |
| 10,665,160 | B2 * | 5/2020 | Ota | G09G 3/2014 |
| 10,902,803 | B2 * | 1/2021 | Han | G09G 3/36 |
| 2007/0115244 | A1 * | 5/2007 | Shin | G09G 3/3266 345/100 |
| 2010/0033456 | A1 * | 2/2010 | Yoshida | G09G 3/3648 345/207 |
| 2014/0333686 | A1 * | 11/2014 | Kim | G09G 3/3233 345/694 |
| 2017/0206841 | A1 * | 7/2017 | Maeda | G09G 3/3291 |
| 2019/0156746 | A1 | 5/2019 | Kim et al. | |

* cited by examiner

DISPLAY DEVICE AND DRIVING METHOD OF THE DISPLAY DEVICE

CROSS-REFERENCE TO RELATED APPLICATION

This application claims priority to and the benefit of Korean patent application no. 10-2019-0033888, filed in the Korean Intellectual Property Office on Mar. 25, 2019, the entire contents of which is incorporated herein by reference.

BACKGROUND

1. Field

Aspects of some example embodiments of the present disclosure generally relate to a display device and a driving method of the display device.

2. Description of the Related Art

In general, a display device includes a display panel and a panel driver. The display panel includes a plurality of gate lines and a plurality of data lines. The panel driver includes a gate driver configured to provide a gate signal to the plurality of gate lines and a data driver configured to provide a data voltage to the plurality of data lines.

The display panel displays an image, based on the gate signal and the data voltage. When the same image is displayed on the display panel for a long time, pixels in the display panel may become degraded, and therefore, an afterimage may occur. The afterimage may be intensified in a specific area in which a fixed image such as a logo, a time, or a subtitle is continuously displayed.

The above information disclosed in this Background section is only for enhancement of understanding of the background and therefore it may contain information that does not constitute prior art.

SUMMARY

Some example embodiments include a display device that may be capable of preventing or reducing the occurrence of an afterimage due to an image that is fixedly displayed, and a driving method of the display device.

Some example embodiments may also include a display device capable of preventing or reducing instances of an afterimage by providing compensated image data to a display panel during a compensation period in a frame, and a driving method of the display device.

According to some example embodiments of the present disclosure, a display device includes: a display panel including a plurality of pixels each coupled to a scan line and a data line; a scan driver configured to supply a first scan signal to the scan line in a scan period in one frame, and supply a second scan signal to the scan line in a compensation period after the scan period; and a data driver configured to supply a first data signal to the data line in synchronization with the first scan signal, and supply a second data signal to the data line in synchronization with the second scan signal, wherein the first data signal is generated based on input image data supplied from the outside, and the second data signal is generated based on a conversion image data obtained by converting a grayscale of the input image data.

According to some example embodiments, the conversion image data may be reversal image data generated based on a reversal grayscale value obtained by reversing the grayscale of the input image data, corresponding to a grayscale value of the input image data. The sum of the grayscale value and the reversal grayscale value may correspond to a maximum grayscale value determined according to a bit number of the input image data.

According to some example embodiments, a supply timing of the second scan signal in the one frame may be the same or varies with respective to consecutive frames.

According to some example embodiments, the length of the one frame may vary corresponding to the supply timing of the second scan signal.

According to some example embodiments, the supply timing of the second scan signal may be determined according to a number of times a first data signal corresponding to the same input image data is consecutively supplied.

According to some example embodiments, the display device may further include an emission driver configured to supply an emission control signal to the pixels in an emission period between the scan period and the compensation period.

According to some example embodiments, a supply period of the emission control signal may vary corresponding to the supply timing of the second scan signal.

According to some example embodiments, the scan driver may supply the first scan signal to the scan line in the scan period in the one frame in a first mode, and supply the first scan signal and the second scan signal to the scan line in a second mode. The data driver may supply the first data signal to the data line in synchronization with the first scan signal in the first mode, and supply the first data signal and the second data signal to the data line in the second mode.

According to some example embodiments, the scan driver and the data driver may operate in the second mode, when a first data signal corresponding to the same input image data is consecutively supplied a predetermined number of times or more.

According to some example embodiments, lengths of the one frame in the first mode and the second mode may be set equal to or different from each other.

According to some example embodiments, each of the pixels may include: a light emitting device; a first transistor coupled between a driving power voltage and the light emitting device, the first transistor having a gate electrode coupled to a first node; a second transistor coupled between the data line and the first node, the second transistor having a gate electrode coupled to the scan line; and a capacitor coupled between the driving power voltage and the first node. When the second scan signal is supplied to the scan line, a voltage corresponding to the second data signal may be applied to the gate electrode of the first transistor via the second transistor and the first node.

According to some example embodiments of the present disclosure, in a method for driving a display device including a plurality of pixels each coupled to a scan line and a data line, the method includes: generating a first data signal, based on input image data supplied from the outside; supplying a first scan signal to the scan line in a scan period in one frame, and supplying the first data signal to the data line in synchronization with the first scan signal; generating a second data signal, based on conversion image data obtained by converting a grayscale of the input image data; and supplying a second scan signal to the scan line in a compensation period after the scan period according to an operation mode of the display device, and supplying the second data signal to the data line in synchronization with the second scan signal.

According to some example embodiments, the generating of the second data signal may include: acquiring a grayscale value of the input image data; generating a reversal grayscale value by reversing the grayscale of the input image data, corresponding to the grayscale value of the input image data; and generating the second data signal, corresponding to the reversal grayscale. The sum of the grayscale value and the reversal grayscale value may correspond to a maximum grayscale value determined according to a bit number of the input image data.

According to some example embodiments, a supply timing of the second scan signal in the one frame may be the same or varies with respect to consecutive frames.

According to some example embodiments, the length of the one frame may vary corresponding to the supply timing of the second scan signal.

According to some example embodiments, the method may further include determining a supply timing of the second scan signal, based on a number of times a first data signal corresponding to the same input image data is consecutively supplied.

According to some example embodiments, the method may further include, after the supplying of the first scan signal and the first data signal, supplying an emission control signal to the pixels. A supply period of the emission control signal may vary corresponding to the supply timing of the second scan signal.

According to some example embodiments, the method may further include determining the operation mode of the display device as any one of a first mode and a second mode. The supplying of the second scan signal and the second data signal may be performed when the operation mode is the second mode.

According to some example embodiments, lengths of the one frame in the first mode and the second mode may be set equal to or different from each other.

According to some example embodiments, the determining of the operation mode of the display device may include determining the operation mode as the second mode, when a first data signal corresponding to the same input image data is consecutively supplied a predetermined number of times or more.

BRIEF DESCRIPTION OF THE DRAWINGS

Aspects of some example embodiments will now be described more fully hereinafter with reference to the accompanying drawings; however, they may be embodied in different forms and should not be construed as limited to the embodiments set forth herein. Rather, these example embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
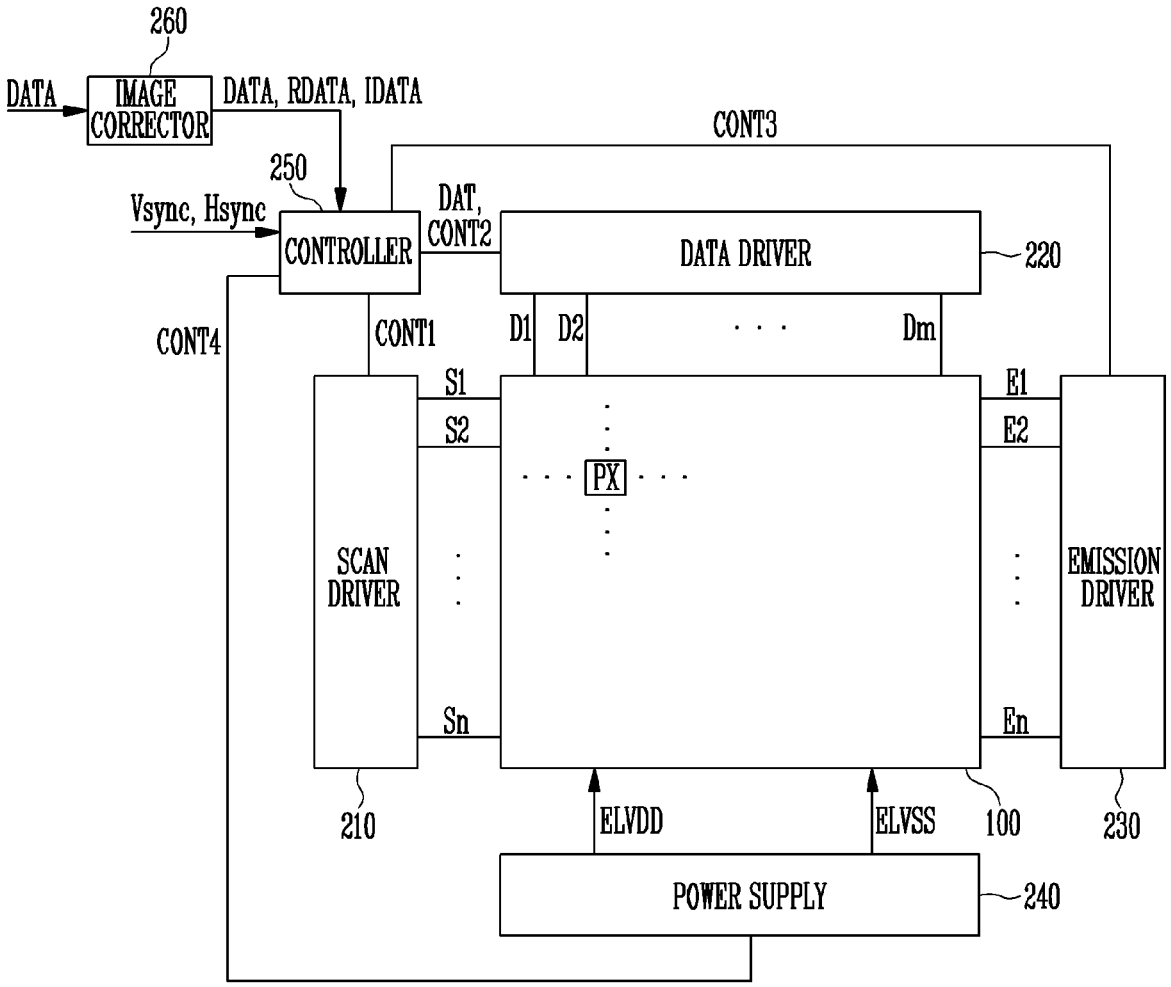
FIG. 1 is a block diagram illustrating a display device according to some example embodiments of the present disclosure.

Hereinafter, aspects of some example embodiments will be described in more detail with reference to the accompanying drawings. The present invention, however, may be embodied in various different forms, and should not be construed as being limited to only the illustrated example embodiments herein. Rather, these embodiments are provided as examples so that this disclosure will be thorough and complete, and will more fully convey the aspects and features of the present invention to those skilled in the art. Accordingly, processes, elements, and techniques that are not necessary to those having ordinary skill in the art for a complete understanding of the aspects and features of the present invention may not be described or shown in the figures. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers, and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the terms "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." In addition, the use of alternative language, such as "or," when describing embodiments of the present invention, refers to "one or more embodiments of the present invention" for each corresponding item listed. As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device in according to some example embodiments of the present disclosure.

Referring to FIG. 1, the display device according to some example embodiments of the present disclosure may include a display panel 100 including a plurality of pixels PX, a scan driver 210, a data driver 220, an emission driver 230, a power supply 240, a controller 250, and an image corrector 260.

The image corrector 260 may receive input image data DATA from the outside (e.g., an image source or an external source). According to some example embodiments, the image corrector 260 may supply the input image data DATA to the controller 250, or correct the input image data DATA and supply the corrected correction image data RDATA to the controller 250. According to some example embodiments, the image corrector 260 may generate the corrected correction image data RDATA by increasing the luminance of the input image data DATA by an offset (e.g., a predetermined offset). According to some example embodiments, the image corrector 260 may pre-store a luminance offset for the correction image data RDATA in the form of a look-up table.

According to some example embodiments of the present disclosure, the image corrector 260 may generate compensation image data DATA from the input image data DATA and supply the compensation image data DATA to the controller 250.

The compensation image data DATA may be data having a grayscale reversed from that of the input image data DATA. For example, the image corrector 260 may generate the compensation image data IDATA by acquiring luminance information of the input image data DATA and reversing a luminance value. That is, the image corrector 260 may acquire a grayscale value (e.g., may be represented with 8 to 12 bits) included in the input image data DATA. Also, the image corrector 260 may calculate a reversal grayscale value obtained by reversing the grayscale of the input image data DATA, corresponding to the grayscale value. That is, the image corrector 260 may symmetrically adjust the grayscale value of the input image data DATA within the range of all grayscale values. Therefore, the sum of the grayscale value of the input image data DATA and the reversal grayscale value may represent a maximum grayscale value (e.g., 255) of the input image data DATA.

According to some example embodiments, when input data (gamma data) of the input image data DATA is represented with 8 bits, all grayscales are 256 grayscales, and the range of all grayscale values becomes 0 to 255. When the grayscale value of the input image data DATA is reversed within the range of all the grayscale values, the sum of the grayscale value of the input image data DATA and the grayscale value of the compensation image data IDATA having the grayscale reversed from that of the input image data DATA may be 255 that is the maximum grayscale value.

According to some example embodiments, when the grayscale value of the input image data DATA is 0 (e.g., when the input image data is a black image), the grayscale value of the compensation image data IDATA may be 255 (e.g., a white image). On the other hand, when the grayscale value of the input image data DATA is 255, the grayscale value of the compensation image data DATA may be 0.

However, according to some example embodiments of the present disclosure, the method for generating the compensation image data IDATA is not limited to the above-described embodiment. That is, according to some example embodiments, the sum of the grayscale value of the input image data DATA and the grayscale value of the compensation image data IDATA having the grayscale reversed from that of the input image data DATA may be set smaller or greater than the grayscale value of the maximum grayscale.

The compensation image data IDATA is generated such that a threshold voltage characteristic of pixels PX is prevented from being changed when input image data about a fixed image is displayed on the display panel 100 for a long time. That is, when a threshold voltage characteristic of specific pixels PX is changed by display of a fixed image for a long time, the compensation image data IDATA may be generated to correspond to a data voltage required to reset the threshold voltage characteristic as the original value. Correction of a threshold voltage characteristic of pixels PX by using the compensation image data IDATA will be described in more detail below with reference to FIG. 7.

According to some example embodiments of the present disclosure, the compensation image data IDATA may be generated for every frame by the image corrector 260. Alternatively, the compensation image data IDATA may be pre-stored in the form of a look-up table, etc., corresponding to the input image data DATA. However, embodiments according to the present disclosure are not limited thereto.

The controller 250 may receive the input image data DATA from the image corrector 260, or receive the correction image data RDATA or the compensation image data IDATA from the image corrector 260. Also, the controller 250 may receive control signals from the outside. The control signals may include a vertical synchronization signal Vsync, a horizontal synchronization signal Hsync, and the like, but the present disclosure is not limited thereto.

The controller 250 may generate a scan driving control signal CONT1, a data driving control signal CONT2, an emission driving control signal CONT3, and a power driving control signal CONT4, based on the input control signals. The scan driving control signal CONT1 generated by the controller 250 may be supplied to the scan driver 210, the data driving control signal CONT2 generated by the controller 250 may be supplied to the data driver 220, the emission driving control signal CONT3 generated by the controller 250 may be supplied to the emission driver 230, and the power driving control signal CONT4 generated by the controller 250 may be supplied to the power supply 240.

The scan driving control signal CONT1 may include a plurality of clock signals and a scan start signal. The scan start signal is a signal for generating a first scan signal for displaying an image of one frame. The clock signal is a synchronization signal for sequentially applying a scan signal to scan lines S1 to Sn.

The data driving control signal CONT2 may include a source start pulse and clock signals. The source start pulse may control a sampling start time of data, and the clock signals may be used to control a sampling operation.

The emission driving control signal CONT3 may include an emission start pulse and clock signals. The emission start pulse may control a first timing of an emission control signal. The clock signals may be used to shift the emission start pulse.

Also, the controller 250 may generate an image data signal DAT by processing the input image data DATA, the correction image data RDATA or the compensation image data IDATA, and supply the generated image data signal DAT to the data driver 220.

According to some example embodiments of the present disclosure, the controller 250 may control the scan driver 210, the data driver 220, and the emission driver 230 according to an operation mode. For example, in a first mode, the controller 250 may control the scan driver 210, the data driver 220, and the emission driver 230 to supply a scan signal and a data signal to the pixels during a scan period in one frame and supply an emission control signal to the pixels PX during an emission period after the scan period. For example, in a second mode, the controller 250 may control the scan driver 210, the data driver 220, and the emission driver 230 to further supply a scan signal and a data signal to the pixels PX during a compensation period after the emission period. In an embodiment, the data signal supplied to the pixels PX in the compensation period may be different from that supplied to the pixels PX in the scan period. For example, the data signal supplied to the pixels PX in the scan period may be generated based on the input image data DATA or the correction image data RDATA, and the data signal supplied to the pixels PX in the compensation period may be generated based on the compensation image data IDATA.

The scan driver 210 may supply a scan signal to the scan lines S1 to Sn, corresponding to the scan driving control signal CONT1. The scan signal may be set to a gate-on voltage (e.g., a high level voltage) at which transistors included in the pixels PX can be turned on. According to some example embodiments of the present disclosure, the scan driver 210 may supply a scan signal having a turn-on level to the scan lines S1 to Sn at least twice during one frame.

When the display device operates in the second mode, the scan driver 210 may supply a scan signal having a turn-on level to the scan lines S1 to Sn at least twice in one frame. Therefore, the supply timing of the scan signal may vary.

The data driver 220 may supply a data signal corresponding to the image data signal DAT to data lines D1 to Dm, corresponding to the data driving control signal CONT2. The data signal supplied to the data lines D1 to Dm may be supplied to pixels PX to which the scan signal is supplied. To this end, the data driver 220 may supply the data signal to the data lines D1 to Dm to be synchronized with the scan signal.

According to some example embodiments of the present disclosure, when the display device operates in the second mode, the data driver 220 may supply a data signal corresponding to the input image data DATA or the correction image data RDATA to the data lines D1 to Dm in synchronization with a scan signal having a turn-on level (hereinafter, referred to as a first scan signal) during the scan period. Also, the data driver 220 may supply a data signal corresponding to the compensation image data IDATA to the data lines D1 to Dm in synchronization with a scan signal having a turn-on level (hereinafter, referred to as a second scan signal) during the compensation period.

The emission driver 230 may supply an emission control signal to emission control lines E1 to En, corresponding to the emission driving control signal CONT3. The emission control signal may be used to control an emission time of the pixels PX. For example, a specific pixel PX supplied with the emission control signal may be set to an emission state during a supply period of the emission control signal (e.g., during a supply period of an emission control signal having a turn-on level), and be set to a non-emission state during the other period (e.g., during a supply period of an emission control signal having a turn-off level). According to some example embodiments of the present disclosure, the emission driver 230 may supply an emission control signal having a turn-on level to the emission control lines E1 to En during the emission period between the scan period and the compensation period.

The power supply 240 may supply a driving power voltage to each of the pixels PX of the display panel 100, based on the power driving control signal CONT4. For example, the power supply 240 may supply a first driving power voltage ELVDD and a second driving power voltage ELVSS to the display panel 100. The first driving power voltage ELVDD may be set to a high-potential voltage, and the second driving power voltage ELVSS may be set to a low-potential voltage.

The display panel 100 may include a plurality of pixels PX coupled to the data lines D1 to Dm, the scan lines S1 to Sn, and the emission control lines E1 to En. Each of the pixels PX may be supplied with a data signal from one of the data lines D1 to Dm, which is coupled thereto, when a scan signal is supplied from one of the scan lines S1 to Sn, which is coupled thereto. The pixel PX supplied with the data signal may control an amount of current flowing from the first driving power voltage ELVDD to the second driving power voltage ELVSS via a light emitting device (e.g., an OLED), corresponding to the data signal. The light emitting device may generate light with a luminance (e.g., a predetermined luminance) corresponding to the amount of current.

Meanwhile, although a case where the image corrector 260 is an independent component is illustrated in FIG. 1, the present disclosure is not limited thereto. That is, according to some example embodiments, the image corrector 260 may be integrally formed with the controller 250 or be mounted in the controller 250. Alternatively, functions of the image corrector 260 may be dividedly performed by at least one of the controller 250, the scan driver 210, and the data driver 220.

Figure 2:
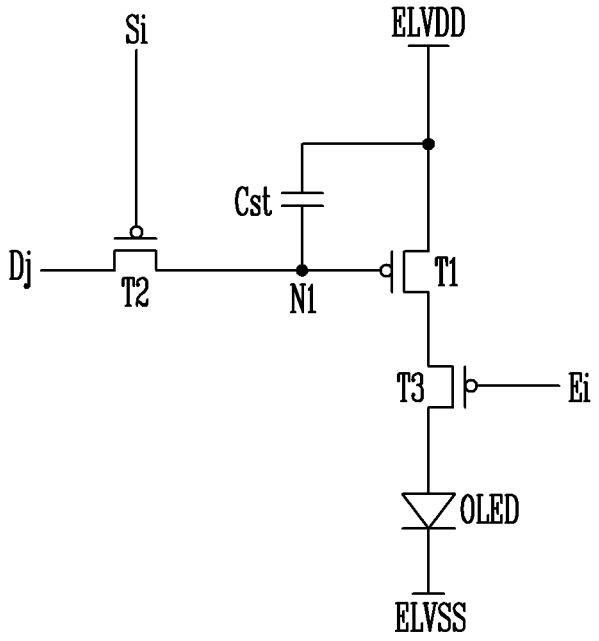
FIG. 2 is a diagram illustrating further details according to some example embodiments of a pixel shown in FIG. 1.

FIG. 2 is a diagram illustrating an embodiment of the pixel shown in FIG. 1. For convenience of description, a pixel PX coupled to an ith scan line Si, a jth data line Dj, and an ith emission control line Ei is illustrated in FIG. 2.

Referring to FIG. 2, the pixel PX according to some example embodiments of the present disclosure may include first to third transistors T1, T2, and T3, a storage capacitor Cst, and a light emitting device OLED.

The first transistor (driving transistor) T1 is coupled between the first driving power voltage ELVDD and the third transistor T3. A gate electrode of the first transistor T1 is coupled to a first node N1. The first transistor T1 may be turned on corresponding to a voltage of the first node N1. When the first transistor T1 is turned on, a driving current may flow from the first driving power voltage ELVDD to the light emitting device OLED via the third transistor T3, corresponding to a voltage stored in the storage capacitor Cst.

The second transistor (switching transistor) T2 is coupled between the data line Dj and the first node N1. A gate electrode of the second transistor T2 is coupled to the scan line Si. The second transistor T2 may be turned on when a scan signal having a turn-on level is supplied to the scan line Si, to supply a data signal supplied to the data line Dj to the first node N1.

The third transistor (emission control transistor) T3 is coupled between the first transistor T1 and the light emitting device OLED. A gate electrode of the third transistor T3 is coupled to the emission control line Ei. The third transistor T3 may be turned on when an emission control signal having a turn-on level is supplied to the emission control line Ei, to selectively supply the driving current supplied from the first transistor T1 to the light emitting device OLED.

The storage capacitor Cst is coupled between the first node N1 and the first driving power voltage ELVDD. When a data signal is supplied to the first node N1 via the second transistor T2, the storage capacitor Cst may store a voltage corresponding to the data signal.

A first electrode of the light emitting device OLED is coupled to the third transistor T3, and a second electrode of the light emitting device OLED is coupled to the second driving power voltage ELVSS. The first electrode may be an anode electrode, and the second electrode may be a cathode electrode. The light emitting device OLED may generate light with a luminance (e.g., a predetermined luminance) corresponding to the amount of driving current flowing from the first driving power voltage ELVDD to the second driving power voltage ELVSS via the first transistor T1 and the third transistor T3, in response to an amount of the driving current.

In the embodiment shown in FIG. 2, the transistors T1 to T3 constituting the pixel PX may be implemented with a PMOS transistor. However, in various embodiments, at least some of the transistors T1 to T3 may be implemented with an NMOS transistor, and correspondingly, a pixel circuit may be variously modified.

Although an example of a pixel structure is illustrated in FIG. 2, the pixel PX of the display device in accordance with the embodiments of the present disclosure is not limited to the pixel structure shown in FIG. 2, and may have various structures.

Hereinafter, signals supplied to the pixel shown in FIG. 2 in accordance with various embodiments of the present disclosure will be described in more detail.

Figure 3:
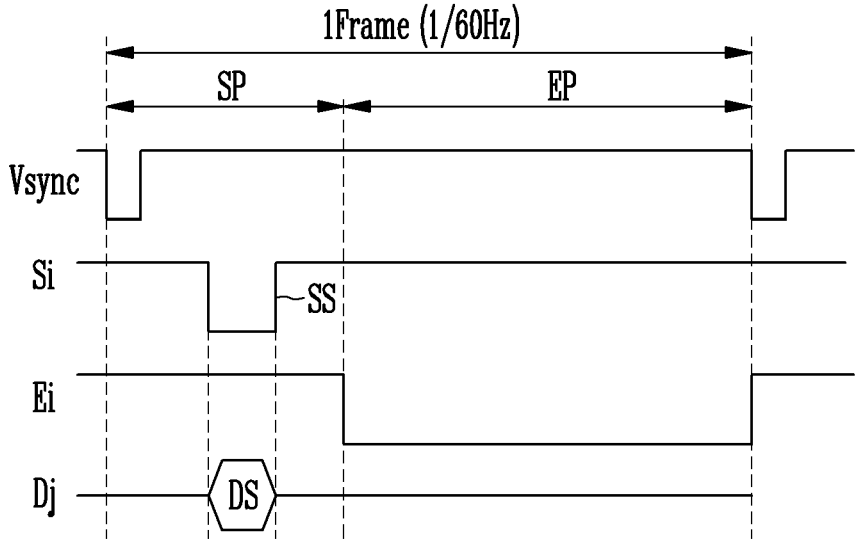
FIG. 3 is a timing diagram illustrating an example of signals supplied to the pixel shown in FIG. 2 in a first mode of the display device according to some example embodiments of the present disclosure.

FIG. 3 is a timing diagram illustrating an example of signals supplied to the pixel shown in FIG. 2 in the first mode of the display device. In FIG. 3, a vertical synchronization signal Vsync is illustrated to represent one frame.

The one frame in the first mode may be configured with a scan period SP and an emission period EP. The length of the one frame in the first mode may be set corresponding to a driving frequency of the display device. For example, the length of the one frame may be set corresponding to a driving frequency of 60 Hz, but the present disclosure is not limited thereto.

Referring to FIGS. 2 and 3 together, during the scan period SP, a data signal DS is supplied to the data line Dj, and a scan signal SS having a turn-on level is supplied to the scan line Si. Then, the first node N1 may be charged with a voltage corresponding to the data signal DS. The data signal DS may be generated based on the input image data DATA provided from the outside or the image corrector 260.

During the scan period SP, an emission control signal has a turn-off level, and accordingly, the third transistor T3 is turned off. Thus, during the scan period SP, a current path from the first driving power voltage ELVDD to the second driving power voltage ELVSS is blocked, and therefore, the light emitting device OLED does not emit light.

During the emission period EP, an emission control signal having a turn-on level is supplied, and therefore, the third transistor T3 is turned on. Then, a current path from the first driving power voltage ELVDD to the second driving power voltage ELVSS via the light emitting device OLED is formed, and therefore, the light emitting device OLED emits light. An amount of current flowing through the light emitting device OLED may correspond to the voltage charged in the first node N1 during the scan period SP.

According to some example embodiments, a period for initializing a gate voltage of the first transistor T1 or compensating for a threshold voltage of the first transistor T1 after the emission period EP may be further provided. According to some example embodiments, a period for sensing a characteristic of each of the pixels PX after the emission period EP may be further provided.

Meanwhile, a case where the scan signal SS is not synchronized with a start time (e.g., a falling edge) of the vertical synchronization signal Vsync is illustrated in FIG. 3. However, embodiments according to the present disclosure are not limited thereto. For example, when the scan line Si is a first scan line S1, a start time of a first scan signal SS1 may be synchronized with that of the vertical synchronization signal Vsync.

Figure 4:
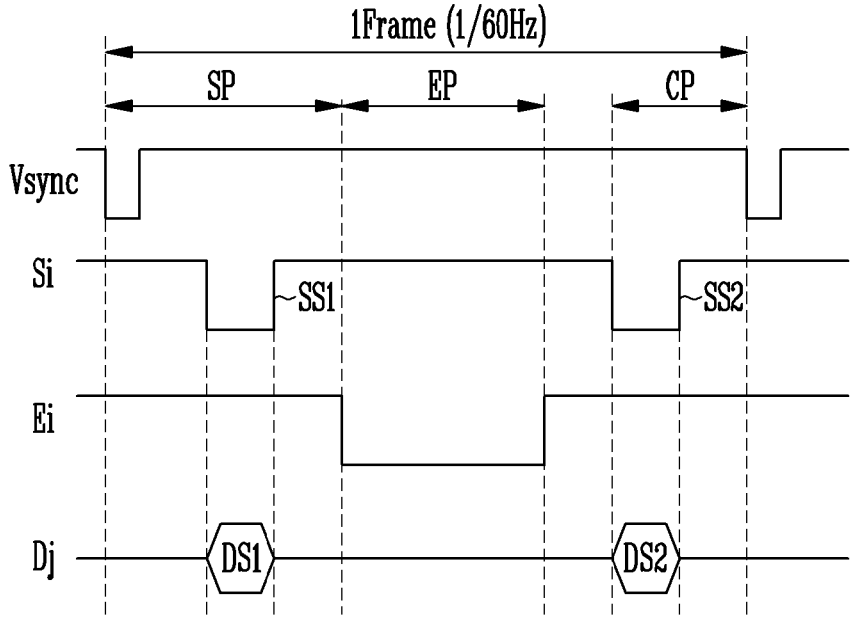
FIG. 4 is a timing diagram illustrating an example of the signals supplied to the pixel shown in FIG. 2 in a second mode of the display device according to some example embodiments of the present disclosure.
Figure 5:
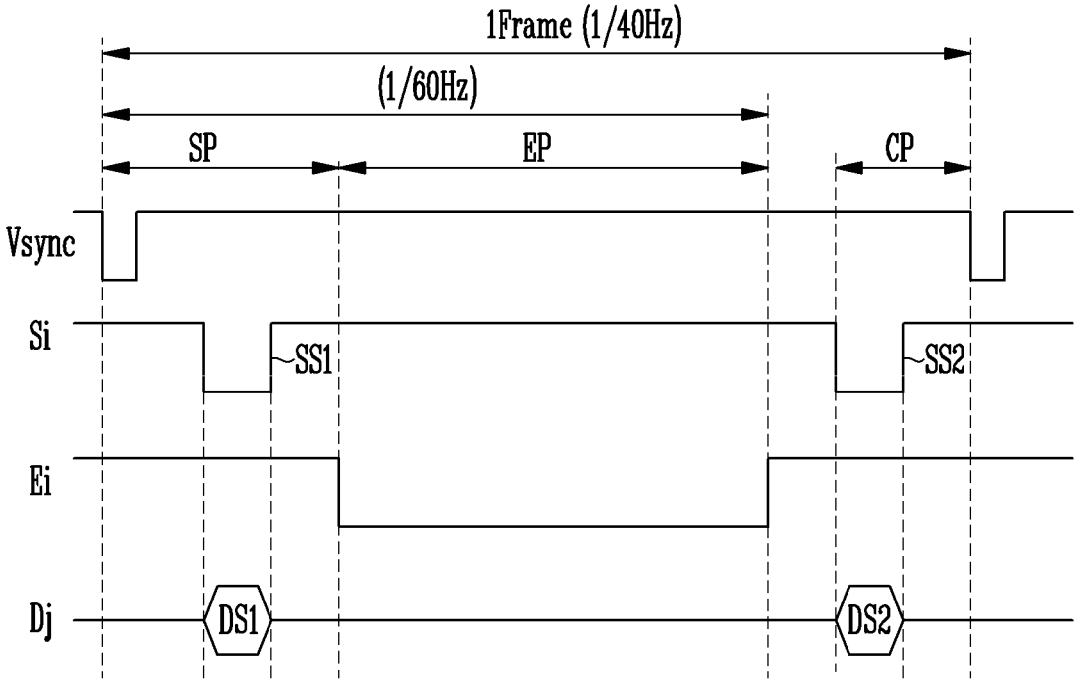
FIG. 5 is a timing diagram illustrating another example of the signals supplied to the pixel shown in FIG. 2 in the second mode of the display device according to some example embodiments of the present disclosure.
Figure 6:
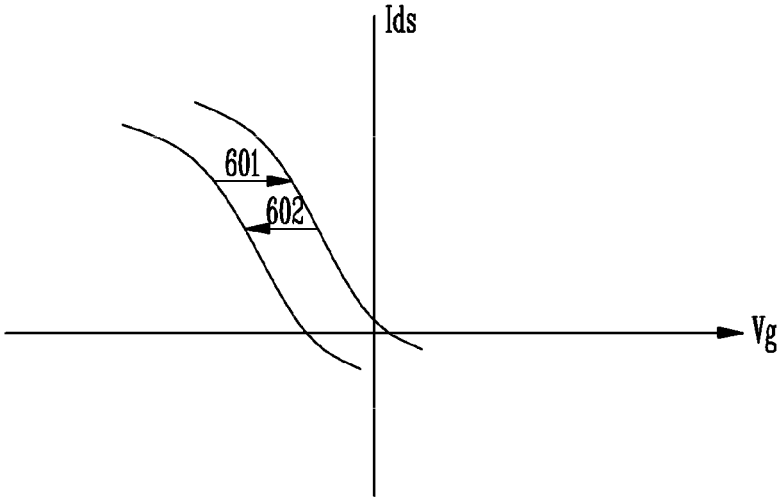
FIG. 6 is a diagram illustrating a change in transistor characteristic when a fixed image is displayed for a long time according to some example embodiments of the present disclosure.
Figure 7:
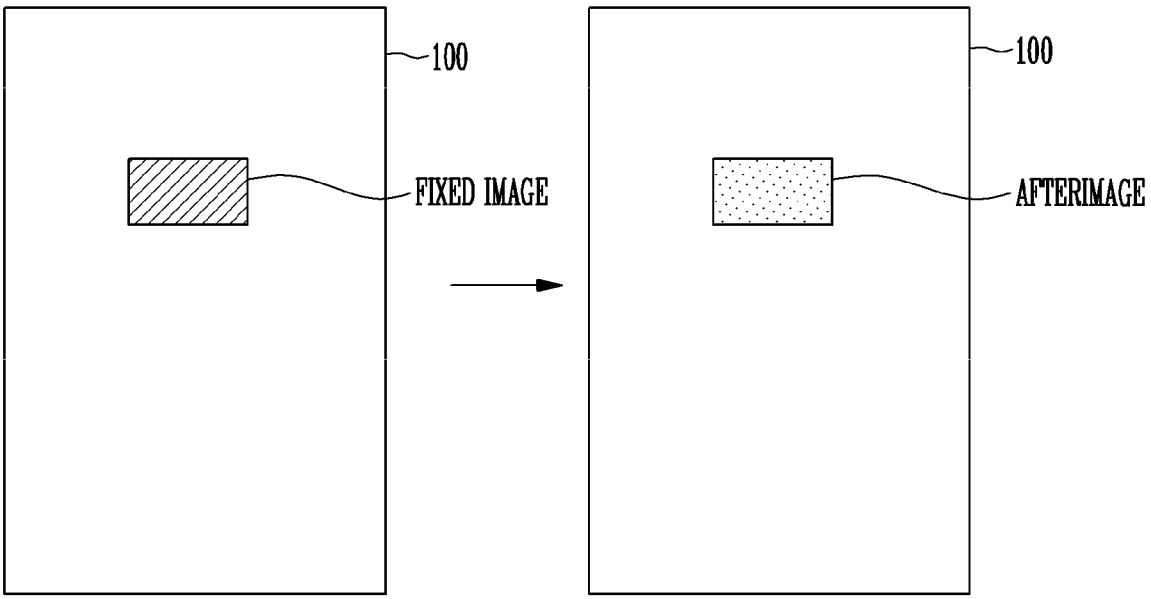
FIG. 7 is a diagram illustrating occurrence of an afterimage when a fixed image is displayed for a long time according to some example embodiments of the present disclosure.

FIG. 4 is a timing diagram illustrating an example of the signals supplied to the pixel shown in FIG. 2 in the second mode of the display device. FIG. 5 is a timing diagram illustrating another example of the signals supplied to the pixel shown in FIG. 2 in the second mode of the display device. FIG. 6 is a diagram illustrating a change in transistor characteristic when a fixed image is displayed for a long time. FIG. 7 is a diagram illustrating occurrence of an afterimage when a fixed image is displayed for a long time.

As compared with the first mode, one frame in the second mode may further include a compensation period CP after the emission period EP. The length of the one frame in the second mode may be equal to or longer than that in the first mode. For example, as shown in FIG. 4, the length of the one frame in the second mode may be set corresponding to the driving frequency of 60 Hz, which is equal to that in the first mode. Therefore, the length of the emission period EP may be shorter than that in the first mode, corresponding to the length of the compensation period CP. According to some example embodiments, when the length of the one frame in the first mode is set corresponding to the driving frequency of 60 Hz, the length of the one frame in the second mode may be set corresponding to a driving frequency of 40 Hz, but embodiments according to the present disclosure are not limited thereto.

Alternatively, as shown in FIG. 5, the length of the one frame in the second mode may be set differently from that in the first mode. For example, the length of the one frame in the second mode may be longer by the length of the compensation period CP than that in the first mode. When the length of the one frame is set longer than that in a general driving method for the purpose of the compensation period CP, the pixel PX can emit light during a sufficient emission period EP, and thus the quality of a display image can be prevented from being degraded.

According to some example embodiments of the present disclosure, the length of the compensation period may vary. When the length of the compensation period CP varies, the length of the emission period EP may vary in the embodiment shown in FIG. 4, or the length of the one frame may vary in the embodiment shown in FIG. 5. The embodiment in which the length of the compensation period CP varies will be described in more detail below with reference to FIG. 9.

The above-described controlling of the length of the one frame may be performed by a vertical synchronization signal Vsync supplied from the outside. For example, in the embodiment shown in FIG. 1, the controller 250 may control the length of the one frame in response to the vertical synchronization signal Vsync supplied from the outside. That is, the controller 250 may determine a start time of the one frame in response to the vertical synchronization signal Vsync supplied from the outside.

Alternatively, the controlling of the length of the one frame may be performed by a separate control signal received from the outside. For example, the controller 250 may determine a start time of the one frame and a length according thereto, based on information or reception timing in a control signal corresponding to the first mode, which is received from the outside.

The embodiments shown in FIGS. 4 and 5 are substantially identical to each other, except that lengths of the one frame in the embodiments shown in FIGS. 4 and 5 are set different from each other, and therefore, the following description may be equally applied to FIG. 4 and %.

Referring to 2, 4, and 5 together, during the scan period SP, a first data signal DS1 is supplied to the data line Dj, and a first scan signal SS1 having a turn-on level is supplied to the scan line Si. Then, the first node N1 may be charged with a voltage corresponding to the first data signal DS1. The first data signal DS1 may be generated based on the input image data DATA or the correction image data RDATA, which is provided from the outside or the image corrector 260.

The correction image data RDATA may be corrected and generated such that the luminance of the input image data DATA is increased by an offset (e.g., a predetermined offset) as described above. When a data signal is provided based on the correction image data RDATA, the pixel PX emits light with a higher luminance during the emission period in the one frame even though the length of the emission period EP is decreased due to the compensation period CP during the one frame. Hence, a difference in quality of an image viewed by a user can be minimized or reduced.

During the scan period SP, an emission control signal has a turn-off level, and accordingly, the third transistor T3 is turned off. Thus, during the scan period SP, the current path from the first driving power voltage ELVDD to the second driving power voltage ELVSS is blocked, and therefore, the light emitting device OLED does not emit light.

During the emission period EP, an emission control signal having a turn-on level is supplied, and therefore, the third transistor T3 is turned on. Then, the current path from the first driving power voltage ELVDD to the second driving power voltage ELVSS via the light emitting device OLED is formed, and therefore, the light emitting device OLED emits light. An amount of current flowing through the light emitting device OLED may correspond to the voltage charged in the first node N1 during the scan period SP.

During the compensation period CP, a second data signal DS2 is supplied to the data line Dj, and a second scan signal SS2 having a turn-on level is supplied to the scan line Si. Then, the first node N1 may be charged with a voltage corresponding to the second data signal DS2.

The second data signal DS2 may be generated based on the compensation image data DATA provided from the image corrector 260. The compensation image data DATA may be data having a grayscale reversed from that of the input image data DATA as described above.

According to some example embodiments, when the first data signal DS1 with respect to the same image is supplied to the pixel PX for a long time, a characteristic of a transistor (e.g., the first transistor T1) provided in the pixel PX may be degraded. That is, when the same voltage is supplied to a gate electrode of the transistor for a long time, a characteristic of the transistor may be changed as shown in FIG. 6 (601). When the characteristic of the transistor is changed, the pixel PX does not properly emit light with a required luminance, and an afterimage may occur as shown in FIG. 7.

According to some example embodiments of the present disclosure, the voltage of the second data signal DS2 corresponding to the compensation image data DATA may be supplied to the pixel PX during the compensation period CP, so that the characteristic of the transistor can be recovered (602). For example, according to some example embodiments of the present disclosure, the voltage of the second data signal DS2 corresponding to the compensation image data DATA is applied to the first node N1, that is, the gate electrode of the first transistor T1 during the compensation period CP, so that the characteristic of the first transistor T1 can be corrected.

Meanwhile, although the second data signal DS2 is applied to the pixel PX during the compensation period PX, any emission control signal is not supplied, and hence the third transistor T3 is turned off. Accordingly, the current path from the first driving power voltage ELVDD to the second driving power voltage ELVSS is blocked, and therefore, the light emitting device OLED does not emit light.

As described above, according to some example embodiments the present disclosure, the second data signal DS2 corresponding to the compensation image data IDATA may be supplied to the pixel PX during the compensation period CP, so that the first transistor T1 in a specific pixel PX can be prevented from being degraded due to a fixed image. Consequently, instances of the occurrence of an afterimage on the display panel 100 may be prevented or reduced.

Figure 8:
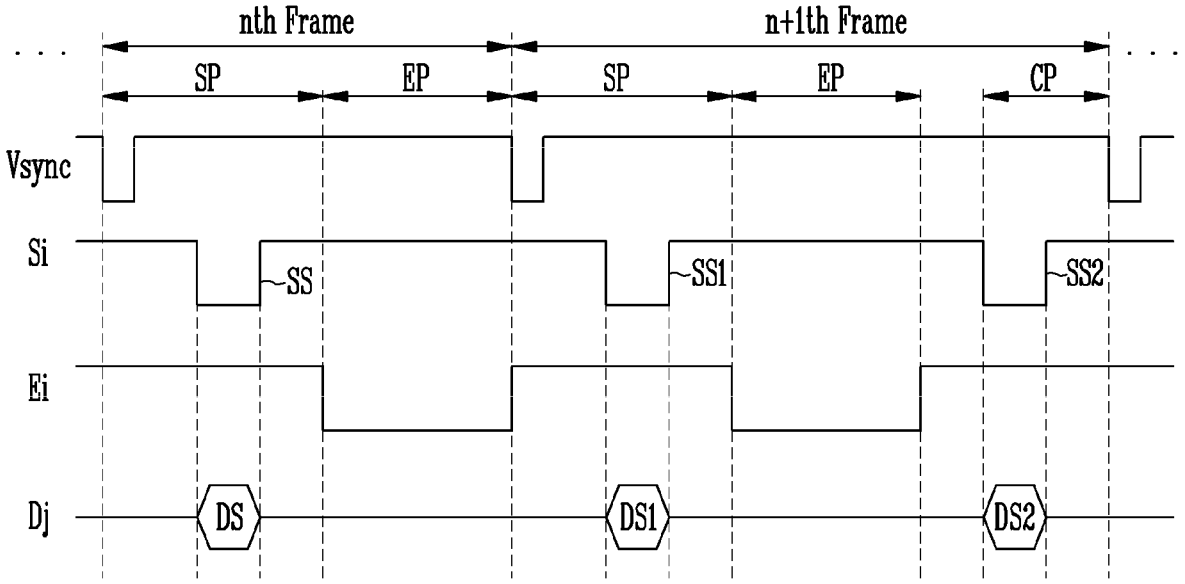
FIG. 8 is a timing diagram illustrating another example of the signals supplied to the pixel shown in FIG. 2 according to some example embodiments of the present disclosure.

FIG. 8 is a timing diagram illustrating an example of the signals supplied to the pixel shown in FIG. 2.

In the embodiment shown in FIG. 8, the display device may operate in the first mode from a first frame to an nth frame, and operate in the second mode from an (n+1)th frame. Therefore, the display device may operate identically as described with reference to FIG. 3 from the first frame to the nth frame, and operate identically as described with reference to FIGS. 4 and 5 from the (n+1)th frame.

According to some example embodiments, when the display device is driven, the display device may operate in the first mode with respect to initial n frames and then operate in the second mode. According to some example embodiments, when a fixed image is repeatedly supplied to the display panel with respect to n frames while the display device is operating in the first mode, the mode of the display device may be switched to the second mode such that the display device operates in the second mode from the (n+1)th frame.

Here, n is a fixed value preset in manufacturing of the display device, and may be stored in the controller 250 or be variably set by a control signal supplied from the outside.

The embodiment of the supplied signals shown in FIG. 8 is substantially identical to those described with reference to FIGS. 3 to 5, except that the mode of the display device is switched such that the display device operates in the switched mode, and therefore, its detailed description will be omitted.

Figure 9:
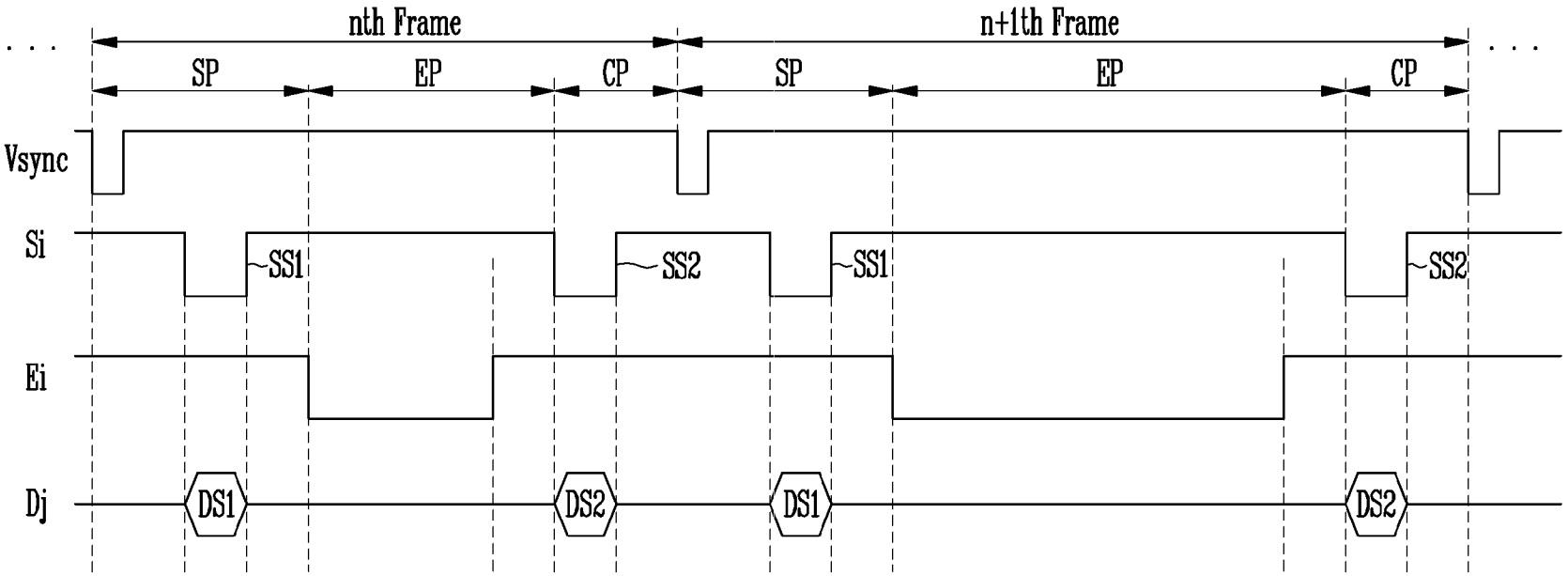
FIG. 9 is a timing diagram illustrating another example of the signals supplied to the pixel shown in FIG. 2 in the second mode of the display device according to some example embodiments of the present disclosure.

FIG. 9 is a timing diagram illustrating still another example of the signals supplied to the pixel shown in FIG. 2 in the second mode of the display device.

Referring to FIG. 9, in various embodiments of the present disclosure, the length of the compensation period CP may vary. Therefore, the length of the compensation period CP may be defined by a supply timing of the second scan signal SS2.

For example, the length of the compensation period CP may be determined corresponding to a number of times (e.g., a time or frame number) the same data signal (e.g., a data signal of a fixed image) is consecutively supplied to a corresponding pixel PX. According to some example embodiments, when the time for which the same data signal is consecutively supplied to the corresponding pixel PX becomes longer, the length of the compensation period CP may become longer corresponding to the time (e.g., the supply timing of the second scan signal SS2 in one frame may become faster).

When the compensation period CP varies, the length of the emission period EP may be shortened or lengthened according to the length of the compensation period CP, when the length of the one frame is fixed as shown in FIG. 9. That is, when the length of the compensation period CP in the one frame is lengthened, the emission period EP may be shortened corresponding to the length of the compensation period CP.

According to some example embodiments, as illustrated in FIG. 5, when the compensation period CP varies, the length of the emission period EP may not vary. Instead, the length of the one frame may vary corresponding to the length of the compensation period CP. That is, the length of the one frame may be determined as a value obtained by adding the determined length of the compensation period CP to the length of the scan period SP and the emission period EP.

The embodiment of the supplied signals shown in FIG. 9 is substantially identical to those described with reference to FIGS. 4 and 5, except that the length of the compensation period CP between frames varies, and therefore, its detailed description will be omitted.

In the display device and the driving method thereof according to some example embodiments of the present disclosure, instances of the occurrence of an afterimage due to a fixed image that displayed in a specific area for a long time can be prevented or reduced.

Those of ordinary skill in the technical field of the present invention understand that the present invention can be carried out in other specific forms without changing the technical idea or departing from the spirit and scope of embodiments according to the present disclosure. The example embodiments should be considered in descriptive sense only and not for purposes of limitation. Therefore, the scope of the present invention is defined not by the detailed description of the present invention but by the appended claims and their equivalents, and all differences within the scope will be construed as being included in the present invention.

What is claimed is:

1. A display device comprising:

a display panel including a plurality of pixels, a pixel from among the pixels being coupled to a scan line and a data line;

a scan driver configured to supply a first scan signal to the scan line in a scan period in one frame, and to supply a second scan signal to the scan line in a compensation period after the scan period; and a data driver configured to supply a first data signal to the data line in synchronization with the first scan signal, and to supply a second data signal to the data line in synchronization with the second scan signal, wherein the first data signal is generated based on input image data supplied from an image source, and the second data signal is generated based on a conversion image data obtained by converting a grayscale of the input image data, and wherein a length of the compensation period is determined according to a number of times the same first data signal is consecutively supplied.

2. The display device of claim 1, wherein the conversion image data is reversal image data generated based on a reversal grayscale value obtained by reversing the grayscale of the input image data, corresponding to a grayscale value of the input image data, wherein a sum of the grayscale value and the reversal grayscale value corresponds to a maximum grayscale value determined according to a bit number of the input image data.

3. The display device of claim 1, wherein a supply timing of the second scan signal in the one frame is the same or varies with respective to consecutive frames.

4. The display device of claim 3, wherein a length of the one frame varies corresponding to the supply timing of the second scan signal.

5. The display device of claim 3, wherein the supply timing of the second scan signal is determined according to a number of times a first data signal corresponding to the same input image data is consecutively supplied.

6. The display device of claim 3, further comprising an emission driver configured to supply an emission control signal to the pixels in an emission period between the scan period and the compensation period.

7. The display device of claim 6, wherein a supply period of the emission control signal varies corresponding to the supply timing of the second scan signal.

8. The display device of claim 1, wherein the scan driver is configured to supply the first scan signal to the scan line in the scan period in the one frame in a first mode, and to supply the first scan signal and the second scan signal to the scan line in a second mode, wherein the data driver is configured to supply the first data signal to the data line in synchronization with the first scan signal in the first mode, and to supply the first data signal and the second data signal to the data line in the second mode.

9. The display device of claim 8, wherein the scan driver and the data driver are configured to operate in the second mode in response to a first data signal corresponding to the same input image data being consecutively supplied a predetermined number of times or more.

10. The display device of claim 8, wherein lengths of the one frame in the first mode and the second mode are set equal to or different from each other.

11. The display device of claim 1, wherein the pixel includes:

a light emitting device;

a first transistor coupled between a driving power voltage and the light emitting device, the first transistor having a gate electrode coupled to a first node;

a second transistor coupled between the data line and the first node, the second transistor having a gate electrode coupled to the scan line; and a capacitor coupled between the driving power voltage and the first node, wherein, in response to the second scan signal being supplied to the scan line, a voltage corresponding to the second data signal is applied to the gate electrode of the first transistor via the second transistor and the first node.

12. A method for driving a display device, the display device including a plurality of pixels, a pixel from among the pixels being coupled to a scan line and a data line, the method comprising:

generating a first data signal, based on input image data supplied from an image source;

supplying a first scan signal to the scan line in a scan period in one frame, and supplying the first data signal to the data line in synchronization with the first scan signal;

generating a second data signal, based on conversion image data obtained by converting a grayscale of the input image data; and supplying a second scan signal to the scan line in a compensation period after the scan period according to an operation mode of the display device, and supplying the second data signal to the data line in synchronization with the second scan signal, and wherein a length of the compensation period is determined according to a number of times the same first data signal is consecutively supplied.

13. The method of claim 12, wherein the generating of the second data signal includes:

acquiring a grayscale value of the input image data;

generating a reversal grayscale value by reversing the grayscale of the input image data, corresponding to the grayscale value of the input image data; and generating the second data signal, corresponding to the reversal grayscale value, wherein a sum of the grayscale value and the reversal grayscale value corresponds to a maximum grayscale value determined according to a bit number of the input image data.

14. The method of claim 12, wherein a supply timing of the second scan signal in the one frame is the same or varies with respect to consecutive frames.

15. The method of claim 14, wherein a length of the one frame varies corresponding to the supply timing of the second scan signal.

16. The method of claim 14, further comprising determining the supply timing of the second scan signal, based on a number of times a first data signal corresponding to the same input image data is consecutively supplied.

17. The method of claim 14, further comprising, after the supplying of the first scan signal and the first data signal, supplying an emission control signal to the pixels, wherein a supply period of the emission control signal varies corresponding to the supply timing of the second scan signal.

18. The method of claim 12, further comprising determining the operation mode of the display device as any one of a first mode and a second mode, wherein the supplying of the second scan signal and the second data signal is performed when the operation mode is the second mode.

19. The method of claim 18, wherein lengths of the one frame in the first mode and the second mode are set equal to or different from each other.

20. The method of claim 18, wherein the determining of the operation mode of the display device includes determining the operation mode as the second mode, when a first data signal corresponding to the same input image data is consecutively supplied a predetermined number of times or more.

* * * * *